United States Patent [19]

Reilly

[11] Patent Number: 4,542,632

[45] Date of Patent: Sep. 24, 1985

[54] HAND-OPERATED KNITTING APPARATUS

[76] Inventor: Patrick J. Reilly, 5 The Larches, Shootersway, Berkhamsted, Hertfordshire, HP4 3TX, England

[21] Appl. No.: 363,564

[22] Filed: Mar. 30, 1982

[30] Foreign Application Priority Data

Apr. 14, 1981 [GB] United Kingdom ..... 8111833

[51] Int. Cl.[4] ..... D04B 7/04

[52] U.S. Cl. ..... 66/64; 66/115; 66/120; 66/60 H

[58] Field of Search ..... 66/115, 114, 60 H, 60, 66/64, 116, 120

[56] References Cited

U.S. PATENT DOCUMENTS

| | | | |
|---|---|---|---|
| 1,683,989 | 9/1928 | Richter | 66/149 R |
| 2,623,372 | 12/1952 | Zielinski | 66/115 |
| 3,024,632 | 3/1962 | Beeri | 66/115 |
| 3,699,784 | 10/1972 | Berentzen | 66/123 |
| 3,712,083 | 1/1973 | Slof et al. | 66/123 |

FOREIGN PATENT DOCUMENTS

| | | | |
|---|---|---|---|
| 591365 | 7/1923 | France | 66/115 |
| 449166 | 7/1949 | Italy | 66/115 |
| 473184 | 6/1952 | Italy | 66/115 |
| 374796 | 3/1964 | Switzerland | 66/149 |
| 798377 | 7/1958 | United Kingdom . | |
| 826393 | 1/1960 | United Kingdom . | |
| 949323 | 2/1964 | United Kingdom . | |
| 1162315 | 8/1969 | United Kingdom . | |
| 1286101 | 8/1972 | United Kingdom . | |
| 1361576 | 2/1974 | United Kingdom . | |
| 1458983 | 12/1976 | United Kingdom . | |

*Primary Examiner*—Ronald Feldbaum

*Attorney, Agent, or Firm*—Charles A. Brown; Charles E. Brown

[57] ABSTRACT

A pair of flat needle beds are disposed in a V-configuration on a frame. Each needle bed includes a plurality of needles which can be extended and retracted by manually grasping butts thereof. When the needles of both beds are extended, a generally V-shaped recess is defined therebetween along which a yarn to be knitted is laid by hand. For single knitting, one of the flat needle beds can be omitted and an attachment can be secured to the frame which has a plurality of fingers which co-operate with the needles in the remaining bed.

8 Claims, 6 Drawing Figures

HAND-OPERATED KNITTING APPARATUS

This invention relates to hand-operated knitting apparatus.

Hand-operated knitting machines intended for domestic use generally comprise a single needle bed and a cam carriage which is traversed across the needle bed by hand. Such machines are, of course, considerably lighter and simpler than industrial knitting machines but are nevertheless sufficiently cumbersome and heavy to render them less than portable and have relatively complex operating mechanisms which render such machines expensive to purchase and repair, especially since it is not normally within the capabilities of the average person to effect repairs to such machines. In addition, there are considerable restrictions on the type of wool which can be used with such machines. For example relatively heavy knitting yarn intended for hand knitting cannot be used on most domestic knitting machines.

It is an object of the present invention to obviate or mitigate these problems.

According to the present invention, a hand-operated knitting apparatus comprises a needle bed including a plurality of knitting needles each of which includes a part which is manually grasped to move the needle between relatively extended and retracted positions on the bed, the needles co-operating either with fixed fingers or with a plurality of similar needles on a further needle bed, such that when each needle is manually moved to its relatively extended position it defines a generally V-shaped recess with each adjacent finger or with an adjacent one of said similar needles, in which recess a yarn is received for knitting.

The apparatus may also comprise a frame having a pair of end parts and a pair of guide means interconnecting the end parts, one of the guide means having said plurality of needles mounted thereon to define the first-mentioned needle bed, while the other guide means is adapted to mount said plurality of similar needles thereon to define said further needle bed. In addition, a plurality of spacers may be disposed in side-by side relation with each pair of adjacent spacers defining therebetween a gap in which a respective one of the needles is slidably located. Advantageously the apparatus is supplied as a kit of parts for the user to assemble the spacers and the needles on the frame.

The invention will now be further described, by way of example, with reference to the accompanying drawings, in which.

Figure 2:
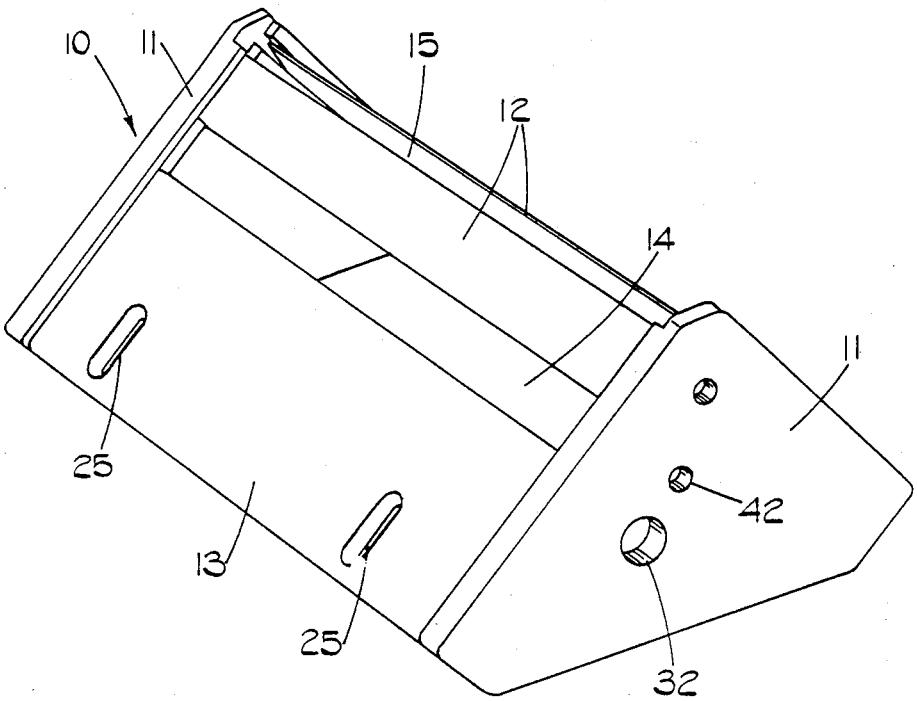
FIG. 2 is a perspective view of a frame of the apparatus shown in FIG. 1.

The illustrated hand-operated knitting apparatus comprises a frame 10 (shown in detail in FIG. 2) which is generally triangular in cross-section and which includes a pair of end parts 11, the sloping sides of the frame each being defined by an upper rail 12 and a lower rail 13 which interconnect the end parts 11 and which are spaced apart so that an elongate slot 14 is formed therebetween. A gap 15 is also provided between the upper rails 12 at the apex of the frame 10, through which the fabric knitted on the apparatus may be taken down.

Figure 1:
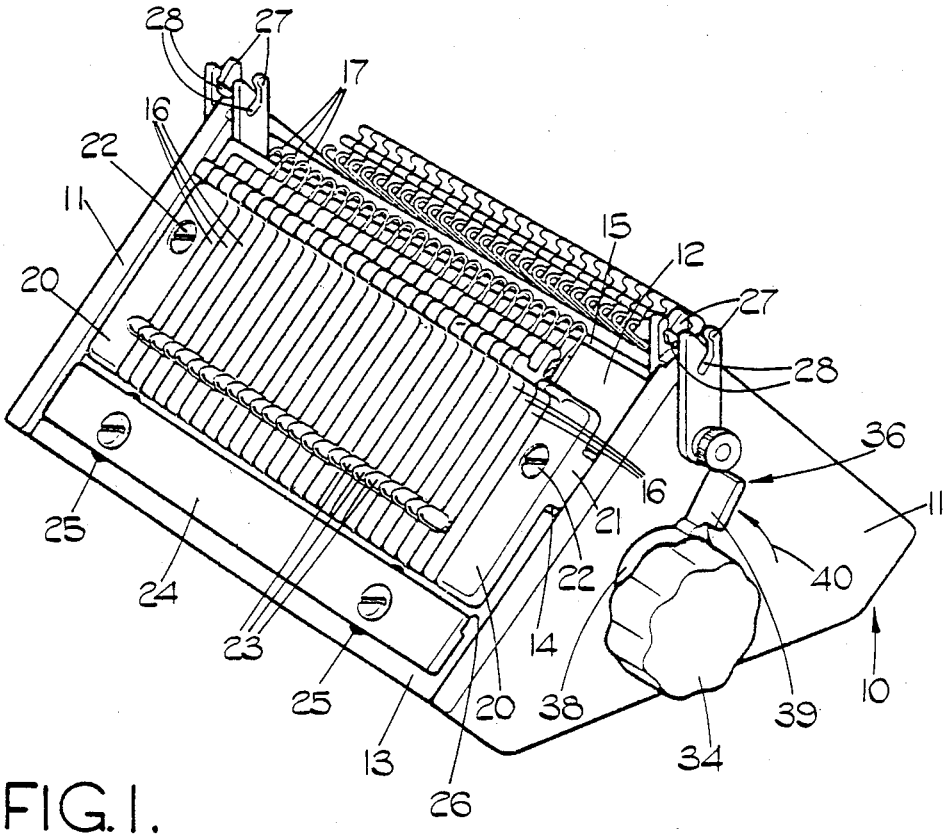
FIG. 1 is a perspective view of hand-operated knitting apparatus according to the present invention assembled for double knitting.
Figure 3:
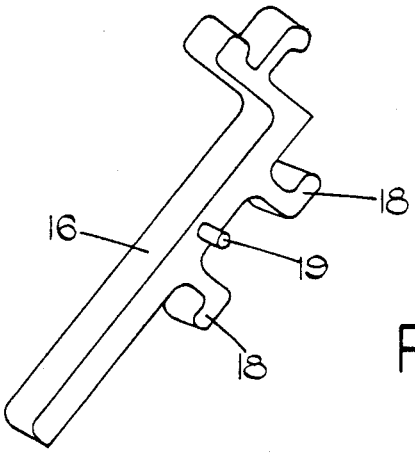
FIGS. 3, 4 and 5 are perspective views of, respectively, a spacer, a take-down device and a ratchet pawl lever which form part of the apparatus shown in FIG. 1.

When the apparatus is set up for double knitting (as depicted in FIG. 1), the sloping sides of the frame 10 form respective flat needle beds which are oriented at an angle (preferably about 90°) to one another to provide a V configuration. Each of these needle beds comprises a plurality of spacers 16 disposed in side-by-side relation and a plurality of needles 17 each of which is slidably received in a gap between a respective adjacent pair of the spacers 16. As can be seen to advantage in FIG. 3, each spacer 16 has L-shaped formations 18 on its underside, and these formations engage under opposite edges of the slot 14 to allow the spacer to be adjusted widthwise of the needle bed. Each spacer also has a pin 19 extending laterally from one side thereof and a correspondingly dimensioned hole (not shown) in its other side. When the spacers are mounted in the needle bed, the pin 19 on each spacer is received in the hole in its neighbour so as to bridge the gap between these spacers, and locates over the respective needle 17 disposed in the gap to retain the needle in position. The spacing between adjacent spacers 16, and hence the ease with which the needles 17 can be moved, can be adjusted by means of clamping members 20 which are disposed respectively at opposite ends of the needle bed. Each clamping member 20 includes a lug 21 which extends into the slot 14, and may be clamped in position by tightening a screw 22 to bring a clamping block (not shown) into engagement with the undersides of the rails 12 and 13. The right-hand clamping member 20 as viewed in FIG. 1 has a hole therein which receives the pin 19 on the next adjacent spacer 16. It will be noted that no needles are disposed between the clamping members 20 and the spacers 16 adjacent thereto.

Each of the needles 17 includes a butt which is covered by a cap 23, the cap being manually grasped by a user of the apparatus to move the needle between relatively extended and retracted positions on the needle bed. The relatively extended position of the needle is fixed, being determined by engagement of the cap 23 with the pin 19 which bridges the respective gap in which the needle is located, while the relatively retracted position is adjustable to vary the size of the knitted stitch, being defined by engagement of a tail end of the needle with a bar 24 which extends across the width of the needle bed. More particularly, the bar 24 is adjustable along slots 25 in the lower rail 13, and has an edge 26 where it is recessed on its underside. Fine adjustment of the stitch size is achieved by moving the bar 24 along the slots 25 in the direction of needle movement, while a more coarse adjustment between large and small stitch sizes is performed by reversing the bar so that the needle tail ends selectively engage its recessed and non-recessed edges, the large stitch size being obtained when the recessed edge 26 confronts the needles as shown in FIG. 1.

The needles 17 in one needle bed are staggered relative to the needles in the other needle bed so that, when the needles are all extended, each needle in one bed is disposed between two adjacent needles in the other bed. In their extended positions, a generally V-shaped recess is defined between the needles in the two beds, along which a yarn is placed ready for knitting. Yarn guides 27 are mounted in pairs on the end parts 11 of the frame 10 for guiding the yarn during such an operation. Each guide 27 has a bent slot 28 therein through which the yarn passes, the guides 27 in each pair being arranged so that the slots 28 bend in opposite directions.

In order to perform a double knitting operation, a slip knot is tied in a loose end of the yarn and this is placed over a needle 17 at one end of the apparatus. The yarn is laid along the recess defined by the extended needles and is passed through the guides 27 at the opposite end of the apparatus. The needles 17 are then retracted one by one alternately between the two beds, starting from said one end of the apparatus, such that successive loops of yarn are captured by the needle hooks. The needles are then all extended so that the loop of yarn on each needle passes downwardly over the needle latch. Following this the yarn is removed from the guides 27 and is once again laid along the recess defined between the extended needles, but this time in the opposite direction to before, the yarn then being passed through the guides 27 at the opposite end of the apparatus. The needles 17 are then retracted one by one as previously but now starting from the other end of the apparatus. As the hook of each needle captures a new loop of yarn, the loop already on the needle moves up the latter and closes the latch, and then rides over the latch and off the needle to form a stitch in a conventional manner. This sequence of operations is repeated as necessary to knit a length of fabric. The tension of the yarn being knitted may be adjusted by turning the outermost of the two guides 27 through which the yarn is passed relative to the innermost guide.

Figure 4:
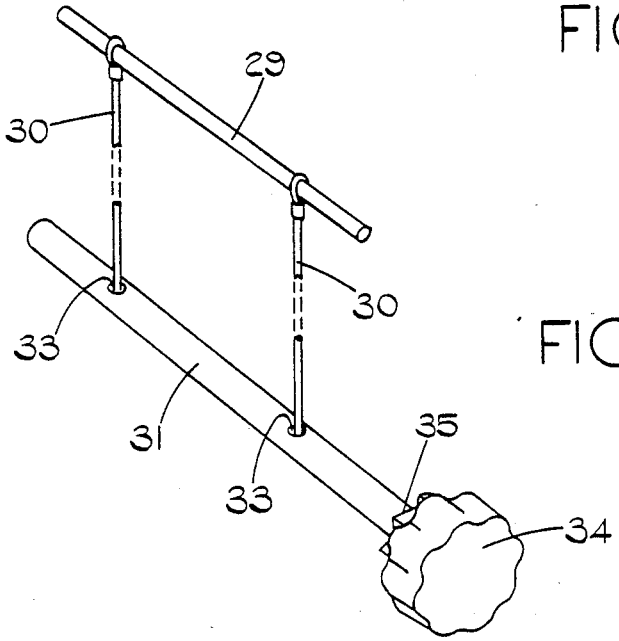
Figure 5:
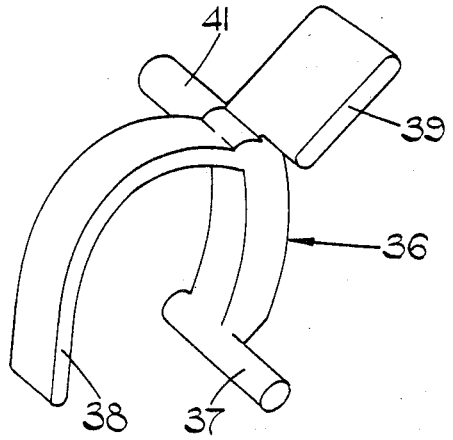

A take-down device (shown in detail in FIG. 4) is provided for drawing off fabric as it is knitted and to exert a pull on the fabric to ensure correct cast-off of the knitted loops. The take-down device comprises a cast-on bar 29 which is placed over the initial loops on the needles, a lace 30 which is looped over opposite ends of the cast-on bar 29, and a roller 31 which is rotatably mounted in respective holes 32 in the frame end parts 11. The lace 30 passes through holes 33 in the roller 31 such that, as the latter is rotated, the lace becomes wound up upon the roller. Such rotation of the roller 31 is performed manually by means of a knob 34, thereby pulling the cast-on bar 29 downwardly and exerting a slight tension in the initial yarn loops. In order to prevent the knob 34 from rotating in the opposite direction to release this tension, a ratchet mechanism is provided, formed by a ratchet wheel 35 which is integral with the knob 34 and a ratchet pawl lever 36 which is pivotally mounted on one of the frame end parts 11. The lever 36 is shown in detail in FIG. 5 and comprises a ratchet pawl 37 and a resilient arm 38 which engages the knob 34 to bias the pawl 37 into engagement with the ratchet wheel 35. The tension applied to the knitted fabric may be released at any time by pressing a tab 39 on the lever 36 in the direction of arrow 40 in FIG. 1, which thereby pivots the lever 36 against the bias provided by the arm 38 to disengage the pawl 37 from the ratchet wheel 35. Reference number 41 denotes a spigot on the lever 36 which is received in a hole 42 in the frame end part 11 for pivotally mounting the lever as aforesaid.

Figure 6:
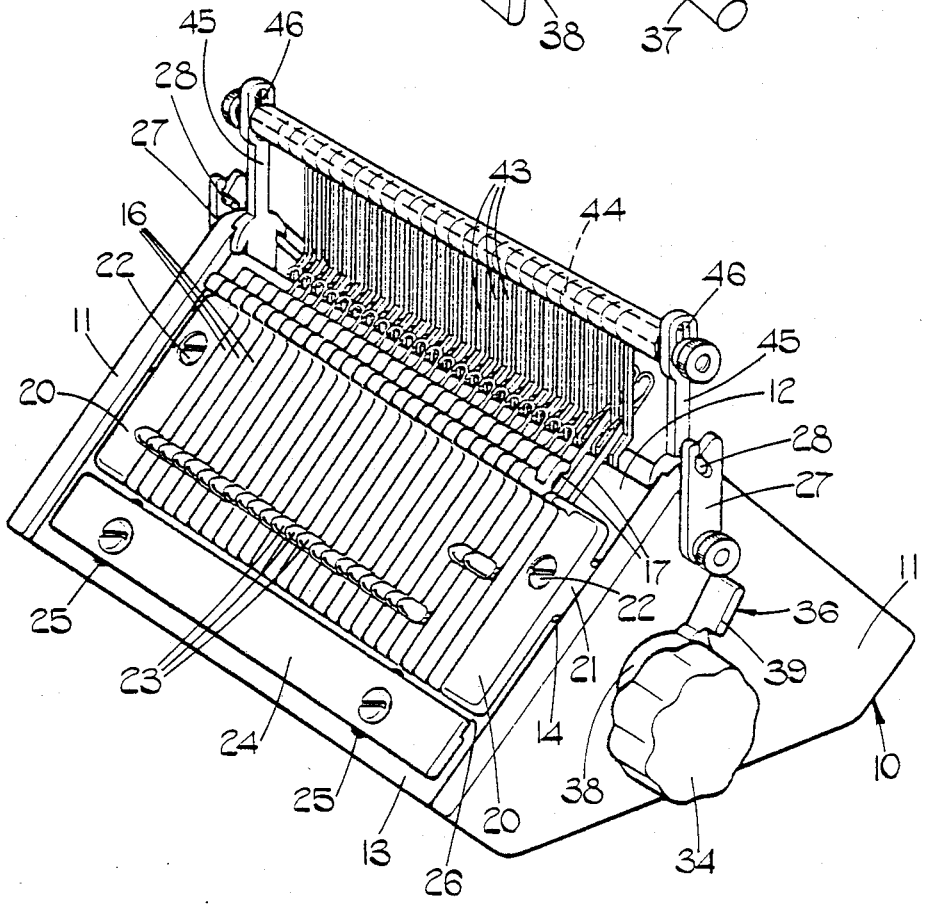
FIG. 6 is a similar view to FIG. 1 but showing the apparatus set up for single knitting.

FIG. 6 shows the same apparatus set up for single knitting, wherein one of the flat needle beds is replaced by a plurality of fingers 43 which alternate with the needles 17 of the remaining bed. The fingers are suspended from a rod 44 which extends across the top of the frame, the rod being supported by support elements 45 which take the place of the innermost yarn guides 27. The rod 44 passes through elongate slots 46 in these elements to enable the heights of the fingers 43 to be adjusted. It will be seen that the lower ends of the fingers 43 are cranked and the upper rail 12 of the needle bed not in use is removed to provide a clearance for the fingers 43. Knitting using the apparatus in this configuration is performed in an analogous manner to that described previously, except that the yarn is now laid along the narrow V-shaped recess defined behind the fingers 43 when the needles 17 are extended. The fingers 43 hold the yarn above the latch on the extended needles, and as each needle is retracted in turn it draws the yarn down into the stitch.

The component parts of the apparatus can be made from any suitable materials. Thus, the frame 10 may be made of plastics or wood. Components such as the spacers 16 are preferably moulded from plastics material since this will make the apparatus quiet in operation and there will be less resistance to movement of the needles 17.

The apparatus described above is very versatile, in that the width of the knitted fabric can be determined simply by choosing how many needles are to be provided in the or each flat bed. Moreover, patterning can easily be achieved by knitting on only selected ones of the needles in each course. To assist in such patterning, the caps 23 may be of different colours. Furthermore, it is possible to vary the stitch size simply by adjusting and/or reversing the bar 24. The apparatus is also able to make use of yarns of many different thicknesses, and more especially can easily handle relatively heavy knitting yarn of the type normally used in hand-knitting.

The apparatus is highly suited to being supplied as a kit of parts for assembly by the user. In addition, the apparatus may be of modular construction with each module providing a needle bed of preselected length, say 5 inches. A suitable knitting width can then be obtained in steps equal to the preselected length by locking such modules together to extend the width of the overall needle bed. In this case, the take-down device and the finger attachment for single knitting can also be supplied in corresponding unit lengths which are interlockable. This would enable the user to purchase a small-sized kit initially and to extend the knitting width as required by purchasing additional knitting beds and like portions.

It will be manifest that the construction of the apparatus may be varied from that described above. For example, the take-down device may include a simple roller with a slot therein through which the knitted fabric is passed, and suitable means (such as hooks) for attaching the fabric to the roller so that it becomes wound therearound as the roller is turned. The finger attachment for single knitting may be mounted on a lever mechanism so that it can be moved into and out of an operative position as desired. The range of movement of the needles 17 may be determined by providing a laterally extending wing on each needle which runs along a slot and which abuts ends of the slot in the extended and retracted positions of the needle, respectively. Although the needles 17 have been described as being of the latch type, it will be appreciated that any other suitable form of needle (such as bearded needles) may be used.

Moreover, although the knitting apparatus has been described above as comprising flat needle beds, the needle beds may instead be curved. It is also possible to apply the present invention to circular knitting apparatus.

I claim:

1. Domestic-type hand-operated knitting apparatus comprising first and second generally flat needle beds, a plurality of knitting needles provided on each of said first and second beds in a manner so as to be movable between extended and retracted positions relative to said bed, said knitting needles of both said first and second beds when in their said extended positions co-operating to define a generally V-shaped recess for the reception of yarn to be knitted, and manually graspable knobs provided on said knitting needles respectively, whereby each said needle is individually manually movable between said extended and retracted positions, each of said needle beds including a plurality of spacers disposed in side-by-side relation, each adjacent pair of said spacers defining therebetween a gap in which a respective one of said needles is slidably located, at least one of said spacers in each said adjacent pair having a laterally extending projection thereon which bridges the gap between said adjacent pair of spacers and which locates over the respective needles in the gap to hold said needle in place.

2. The apparatus according to claim 1, wherein each said spacer has a laterally extending projection which engages in a recess in the next adjacent spacer.

3. The apparatus according to claim 1, wherein each of said needles has a butt, and at least one of said relatively extended and retracted positions of said needle is determined by engagement of said butt with a respective one of said laterally extending projections.

4. Domestic-type hand-operated knitting apparatus comprising a portable frame, first and second generally flat needle beds mounted on said portable frame, a plurality of knitting needles provided on each of said first and second beds in a manner so as to be movable between relatively extended and retracted positions relative to said bed, each of said knitting needles having a hook portion and a manually graspable knob whereby each needle is individually manually moved between said relatively extended and retracted positions, said knitting needles of both said first and second needle beds when in said extended positions defining therebetween a linear recess of substantially V-shaped transverse cross-section along which a yarn is received for knitting, such that the yarn automatically becomes engaged by said hook portion of each said needle as said needle is manually moved into said relatively retracted position, a take-down device which is manually operable to apply tension to fabric as it is knitted by said needles, said take-down device including a manually rotatable member and attachment means by which the fabric can be attached to said rotatable member for winding therearound.

5. The apparatus according to claim 4, wherein said attachment means comprises a cast-on bar which is placed over initial loops knitted by said needles, and at least one lace which is connected to opposite ends of said cast-on bar and which is capable of being wound around said rotatable member.

6. The apparatus according to claim 4, further comprising a ratchet device to permit said rotatable member to be rotated in one direction only, said ratchet device including ratchet teeth on said rotatable member, a pivotable operating lever having a ratchet pawl which engages said ratchet teeth and also having a resilient arm which engages said rotatable member to urge said ratchet pawl against said ratchet teeth, said operating lever being manually pivotable against the action of said resilient arm to disengage said ratchet pawl from said ratchet teeth.

7. Domestic-type hand-operated knitting apparatus comprising a portable frame, first and second generally flat needle beds mounted on said portable frame, a plurality of knitting needles provided on each of said first and second beds in a manner so as to be movable between relatively extended and retracted positions relative to said bed, each of said knitting needles having a hook portion and a manually graspable knob whereby each needle is individually manually moved between said relatively extended and retracted positions, said knitting needles of both said first and second needle beds when in said extended positions defining therebetween a linear recess of substantially V-shaped transverse cross-section along which a yarn is received for knitting, such that the yarn automatically becomes engaged by said hook portion of each said needle as said needle is manually moved into said relatively retracted position, said manually graspable knob on each said needle including a butt on said needle and a cap fitted over said butt.

8. Domestic-type hand-operated knitting apparatus comprising a portable frame, first and second generally flat needle beds mounted on said portable frame, a plurality of knitting needles provided on each of said first and second beds in a manner so as to be movable between relatively extended and retracted positions relative to said bed, each of said knitting needles having a hook portion and a manually graspable knob whereby each needle is individually manually moved between said relatively extended and retracted positions, said knitting needles of both said first and second needle beds when in said extended positions defining therebetween a linear recess of substantially V-shaped transverse cross-section along which a yarn is received for knitting, such that the yarn automatically becomes engaged by said hook portion of each said needle as said needle is manually moved into said relatively retracted position, said second needle bed being replaced by a set of fingers which are fixed relative to said first needle bed and which extend vertically above said frame in alternating relation relative to said needles of said first needle bed to co-operate with said knitting needles of said first needle bed when said needles are in their said extended position to define the linear recess of generally V-shaped transverse cross-section.

* * * * *